US010897111B2

(12) United States Patent
Li

(10) Patent No.: US 10,897,111 B2
(45) Date of Patent: Jan. 19, 2021

(54) POWER INTERFACE, MOBILE TERMINAL AND POWER ADAPTER

(71) Applicant: GUANGDONG OPPO MOBILE TELECOMMUNICATIONS CORP., LTD., Guangdong (CN)

(72) Inventor: Feifei Li, Dongguan (CN)

(73) Assignee: GUANGDONG OPPO MOBILE TELECOMMUNICATIONS CORP., LTD., Guangdong (CN)

( * ) Notice: Subject to any disclaimer, the term of this patent is extended or adjusted under 35 U.S.C. 154(b) by 0 days.

(21) Appl. No.: 16/317,693

(22) PCT Filed: Apr. 20, 2017

(86) PCT No.: PCT/CN2017/081265
§ 371 (c)(1),
(2) Date: Jan. 14, 2019

(87) PCT Pub. No.: WO2018/018952
PCT Pub. Date: Feb. 1, 2018

(65) Prior Publication Data

US 2019/0267763 A1 Aug. 29, 2019

(30) Foreign Application Priority Data

Jul. 27, 2016 (CN) ..... 2016 2 0806348 U

(51) Int. Cl.
*H01R 24/60* (2011.01)
*H01R 12/70* (2011.01)
(Continued)

(52) U.S. Cl.
CPC ..... *H01R 24/60* (2013.01); *H01R 12/7088* (2013.01); *H01R 13/02* (2013.01);
(Continued)

(58) Field of Classification Search
None
See application file for complete search history.

(56) References Cited

U.S. PATENT DOCUMENTS 4,082,407 A * 4/1978 Smorzaniuk ..... H01R 12/721 439/487
5,879,200 A * 3/1999 Sugie ..... H01R 13/41 439/733.1
(Continued)

FOREIGN PATENT DOCUMENTS

CN 102931538 A 2/2013
CN 103166057 A 6/2013
(Continued)

OTHER PUBLICATIONS

English translation of the Written Opinion PCT/CN2017/081265, dated Jul. 26, 2017.
(Continued)

*Primary Examiner* — Oscar C Jimenez

(57) ABSTRACT

A power interface (100), a mobile terminal and a power adapter. The power interface (100) comprises a body portion (110) adapted to connect to a circuit board (160); a plurality of spaced data pins (120), the data pins (120) being connected to the body portion (110); and a plurality of spaced power pins (130), the power pins (130) being connected to the body portion (110) and the power pins (130) being spaced apart from the data pins (120), the power pin (130) comprising a first contact surface (131) adapted to electrically connect to a conductive member and a second contact surface (132), which is adapted to be wrapped by an insulating encapsulation portion (140), the second contact surface (132) having at least one protruding portion (133) so as to increase the current load amount of the power pins (130).

13 Claims, 10 Drawing Sheets

(51) Int. Cl.

| | |
|---|---|
| ***H01R 13/02*** | (2006.01) |
| ***H01R 13/405*** | (2006.01) |
| ***H01R 13/28*** | (2006.01) |
| ***H01R 107/00*** | (2006.01) |

(52) U.S. Cl.
CPC ..... *H01R 13/28* (2013.01); *H01R 13/405* (2013.01); *H01R 2107/00* (2013.01)

(56) References Cited

U.S. PATENT DOCUMENTS

| | | | | |
|---|---|---|---|---|
| 6,527,587 | B1 * | 3/2003 | Ortega | H01R 13/6585 439/607.05 |
| 7,448,918 | B2 * | 11/2008 | Lappoehn | H01R 13/41 439/660 |
| 8,961,237 | B2 | 2/2015 | Xu et al. | |
| 9,728,916 | B1 * | 8/2017 | Tsai | H01R 24/60 |
| 2006/0228948 | A1 | 10/2006 | Swain et al. | |
| 2011/0269341 | A1 * | 11/2011 | He | H01R 13/6467 439/607.01 |
| 2012/0270445 | A1 * | 10/2012 | Kondo | H01R 13/6471 439/626 |
| 2013/0267125 | A1 * | 10/2013 | Tai | H01R 13/6471 439/660 |
| 2014/0065869 | A1 | 3/2014 | Xu et al. | |
| 2014/0073183 | A1 * | 3/2014 | Golko | H01R 13/6594 439/607.34 |
| 2014/0120778 | A1 * | 5/2014 | Yu | H01R 13/7031 439/660 |
| 2014/0206209 | A1 | 7/2014 | Kamei et al. | |
| 2014/0287626 | A1 * | 9/2014 | Lin | H01R 31/06 439/607.56 |
| 2015/0004839 | A1 * | 1/2015 | Wang | H01R 13/6585 439/607.58 |
| 2015/0214684 | A1 * | 7/2015 | Chen | H01R 35/04 439/217 |
| 2016/0064872 | A1 | 3/2016 | Leng et al. | |
| 2016/0372876 | A1 | 12/2016 | Zhang et al. | |
| 2017/0040761 | A1 * | 2/2017 | Tsai | H01R 13/642 |
| 2017/0201052 | A1 * | 7/2017 | Peng | H01R 13/26 |
| 2017/0229823 | A1 * | 8/2017 | Tsai | H01R 24/60 |
| 2017/0302033 | A1 * | 10/2017 | Peng | H01R 13/6581 |
| 2017/0331236 | A1 | 11/2017 | Zhang et al. | |
| 2017/0365961 | A1 * | 12/2017 | Zhao | H01R 13/5202 |
| 2018/0069357 | A1 | 3/2018 | Zhang et al. | |
| 2018/0294592 | A1 * | 10/2018 | Huang | H01R 13/405 |
| 2019/0123474 | A1 * | 4/2019 | Gu | H01R 12/724 |
| 2019/0148854 | A1 * | 5/2019 | Gu | B67D 7/32 |

FOREIGN PATENT DOCUMENTS

| | | | |
|---|---|---|---|
| CN | 203166148 | U | 8/2013 |
| CN | 203553401 | U | 4/2014 |
| CN | 204538336 | U | 8/2015 |
| CN | 104882705 | A | 9/2015 |
| CN | 204905502 | U | 12/2015 |
| CN | 105226428 | A | 1/2016 |
| CN | 204966736 | U | 1/2016 |
| CN | 205282692 | U | 6/2016 |
| CN | 106025616 | A | 10/2016 |
| CN | 205960264 | U | 2/2017 |
| JP | 2015022874 | A | 2/2015 |
| JP | 2015228380 | A | 12/2015 |
| WO | 2015113340 | A1 | 8/2015 |

OTHER PUBLICATIONS

Supplementary European Search Report dated Jun. 13, 2019; Appln. No. 17833258.1.
International Search Report in international application No. PCT/CN2017/081265, dated Jul. 26, 2017.
Written Opinion of the International Search Authority in international application No. PCT/CN2017/081265, dated Jul. 26, 2017.
First Office Action of the Japanese application No. 2019-503736, dated Jan. 7, 2020.
First Office Action of the Korean application No. 10-2019-7002378, dated Mar. 27, 2020.
Office Action of the Indian application No. 201917007098, dated Apr. 24, 2020.
Second Office Action of the Japanese application No. 2019-503736, dated Apr. 28, 2020.
First Office Action of the European application No. 17833258.1, dated May 18, 2020.
Notice of Rejection of the Japanese application No. 2019-503736, dated Sep. 8, 2020.

* cited by examiner

POWER INTERFACE, MOBILE TERMINAL AND POWER ADAPTER

TECHNICAL FIELD

The disclosure relates to the technical field of communication, and particularly, to a power interface, a mobile terminal and a power adapter.

BACKGROUND

With the advancement of technology, the Internet and mobile communication networks have provided massive function applications. A user may use a mobile terminal for a conventional application, for example, using a smart phone to answer the phone or make calls. Meanwhile, the user may also use a mobile terminal for browsing web, transmitting picture, playing game and the like.

When a mobile terminal is used for handling tasks, power of a battery may be greatly consumed due to an increased using frequency of the mobile terminal, and thus the mobile terminal is required to be charged frequently. Due to acceleration of the pace of life, particularly increasing emergencies, a user also expects to charge a battery of a mobile terminal with a high current.

SUMMARY

The disclosure is intended to at least partially overcome or alleviates one of the technical problems in a related art. To this end, the disclosure discloses a power interface which has the advantages of reliable connection and rapid charging.

The disclosure also discloses a mobile terminal, which includes the abovementioned power interface.

The disclosure also discloses a power adapter, which includes the abovementioned power interface.

The power interface according to embodiments of the disclosure includes: a body portion adapted to be connected with a circuit board, multiple data pins spaced from one another and multiple power pins spaced from one another. The data pins are connected with the body portion. The power pins are also connected with the body portion. The power pins are spaced from the data pins. Each power pin includes at least one first contact surface adapted to be connected electrically connected with a conductive member and at least one second contact surface adapted to be wrapped with an insulating coating portion. At least one protrusion is arranged on the second contact surface to increase a current load capacity of the power pin.

According to the power interface of the embodiments of the disclosure, the protrusion is arranged on the second contact surface adapted to be wrapped with the insulating coating portion, and then the current load capacity of the power pin may be increased. Thus, a current transmission speed may be increased, the power interface is endowed with a rapid charging function, and charging efficiency for a battery may be improved.

The mobile terminal according to the embodiments of the disclosure is provided with the abovementioned power interface.

According to the mobile terminal of the embodiments of the disclosure, the protrusion is arranged on the second contact surface adapted to be wrapped with the insulating coating portion, and then the current load capacity of the power pin may be increased. Thus, the current transmission speed may be increased, the power interface is endowed with the rapid charging function, and the charging efficiency for the battery may be improved.

The power adapter according to the embodiments of the disclosure is provided with the abovementioned power interface.

According to the power adapter of the embodiments of the disclosure, the protrusion is arranged on the second contact surface adapted to be wrapped with the insulating coating portion, and then the current load capacity of the power pin may be increased. Thus, the current transmission speed may be increased, the power interface is endowed with the rapid charging function, and the charging efficiency for the battery may be improved.

The power interface according to embodiments of the disclosure includes: a body portion adapted to be connected with a circuit board, multiple data pins spaced from one another and multiple power pins spaced from one another. The data pins are connected with the body portion. The power pins are also connected with the body portion. The power pins are spaced from the data pins. Each power pin includes at least one first contact surface electrically connected with a conductive member and at least one second contact surface not contacting with the conductive member. At least one protrusion is arranged on the second contact surface to increase a current load capacity of the power pin.

According to the power interface of the embodiments of the disclosure, the at least one protrusion is arranged on the second contact surface not contacting with the conductive member, and then the current load capacity of the power pin may be increased. Thus, the current transmission speed may be increased, the power interface is endowed with the rapid charging function, and the charging efficiency for the battery may be improved.

LIST OF REFERENCE SYMBOLS

Figure 1:
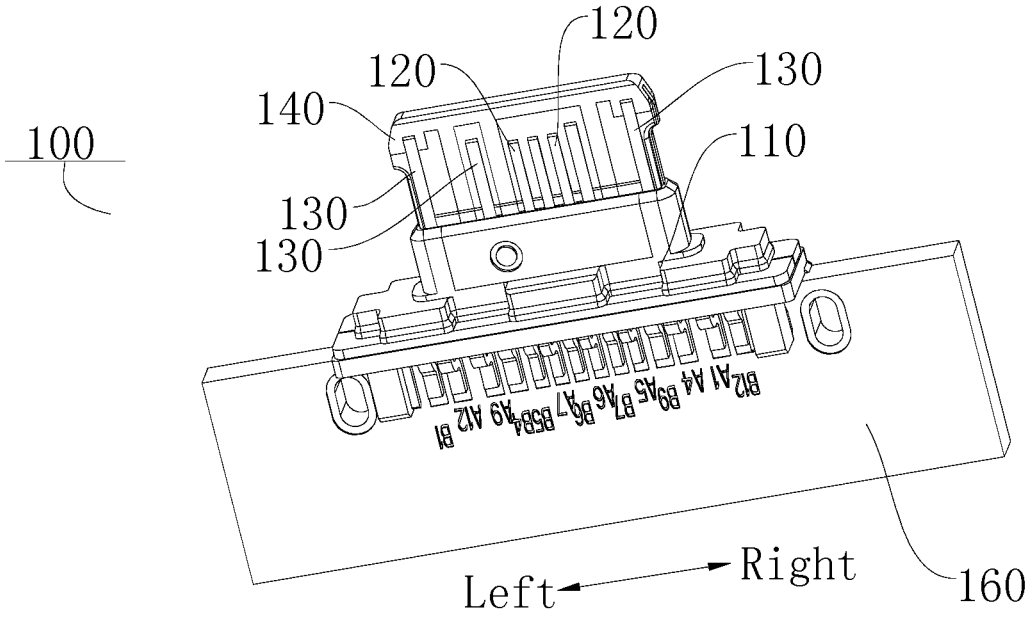
FIG. 1 illustrates a partial structure view of a power interface according to an embodiment of the disclosure.

100 power interface,
110 body portion,
120 data pin,

130 power pin, 131 first contact surface, 132 second contact surface, 133 protrusion,

140 insulating coating portion, 141 first coating portion, 142 second coating portion,

150 middle patch,

160 circuit board

DETAILED DESCRIPTION

The embodiments of the disclosure will be described below in detail and examples of the embodiments are illustrated in the drawings. The embodiments described below with reference to the drawings are exemplary and intended to explain the disclosure and should not be understood as limits to the disclosure.

In the descriptions of the disclosure, it is to be understood that orientation or position relationships indicated by terms "length", "width", "thickness", "upper", "lower", "front", "back", "left", "right", "bottom", "inner", "outer", "circumferential" and the like are orientation or position relationships illustrated in the drawings, are adopted not to indicate or imply that indicated devices or components must be in specific orientations or constructed and operated in specific orientations but only to conveniently describe the disclosure and simplify descriptions and thus should not be understood as limits to the disclosure.

In addition, terms "first" and "second" are only adopted for description and should not be understood to indicate or imply relative importance or implicitly indicate the number of indicated technical features. Therefore, a feature defined by "first" and "second" may explicitly or implicitly indicates inclusion of at least one such feature. In the descriptions of the disclosure, "multiple" means at least two, for example, two and three, unless otherwise limited definitely and specifically.

In the disclosure, unless otherwise definitely specified and limited, terms "mount", "mutually connect", "connect", "fix" and the like should be broadly understood. For example, the terms may refer to fixed connection and may also refer to detachable connection or integration. The terms may refer to mechanical connection and may also refer to electrical connection or mutual communication. The terms may refer to direct mutual connection, may also refer to indirect connection through a medium and may refer to communication in two components or an interaction relationship of the two components, unless otherwise definitely limited.

For those of ordinary skill in the art, specific meanings of these terms in the disclosure can be understood according to a specific condition.

The power interface 100 according to the embodiments of the disclosure will be described below with reference to FIG. 1-FIG. 10 in detail. It is to be noted that the power interface 100 may be an interface for charging or data transmission, and may be provided in a mobile phone, a tablet computer, a notebook computer or another rechargeable mobile terminal. The power interface 100 may be electrically connected with a corresponding power adapter to implement a communication connection of an electrical signal and a data signal.

As illustrated in FIG. 1-FIG. 10, the power interface 100 according to the embodiments of the disclosure includes a body portion 110, data pins 120 and power pins 130.

Specifically, the body portion 110 is adapted to be connected with a circuit board 160, and there may be multiple data pins 120 which are spaced from one another and are connected with the body portion 110. There may be multiple power pins 130 which are spaced from one another and are connected with the body portion 110. The power pins 130 and the data pins 120 are spaced apart. Each power pin 130 includes at least one first contact surface 131 adapted to be electrically connected with a conductive member and at least one second contact surface 132 adapted to be wrapped with an insulating coating portion 140 and at least one protrusion 133 is arranged on the second contact surface 132 to increase a current load capacity of the power pin 130.

According to the power interface 100 of the embodiments of the disclosure, the protrusion 133 is arranged on the second contact surface 131 adapted to be wrapped with the insulating coating portion 140, and then the current load capacity of the power pin 130 may be increased. Thus, a current transmission speed may be increased, the power interface 100 is endowed with a rapid charging function, and charging efficiency for a battery is improved.

According to an embodiment of the disclosure, as illustrated in FIG. 1-FIG. 5, there may be one first contact surface 131. That is, one surface on the power pin 130 is adapted to be electrically connected with the conductive member, and other surfaces of the power pin 130 are adapted to be wrapped with the insulating coating portion 140.

It is to be noted that, during rapid charging of the power interface 100, the power pin 130 with the protrusion 133 may be configured to be loaded with a relatively high charging current. During normal charging of the power interface 100, the insulating coating portion 140 on the power pin 130 may avoid the contact of the power pin 130 with a corresponding pin on a power adapter. Therefore, the power interface 100 in the embodiments may be applied to different power adapters. For example, during rapid charging of the power interface 100, the power interface 100 may be electrically connected with a corresponding power adapter with the rapid charging function. During normal charging of the power interface 100, the power interface 100 may be electrically connected with a corresponding ordinary power adapter, and the insulating coating portion 140 may effectively space the protrusion 133 from a corresponding pin on the power adapter, so as to protect the pin on the power adapter from a charging interference generated by the protrusion 133, thereby improving adaptability of the power interface 100 to the power adapter for normal charging and improving stability of the power interface 100 in a normal charging state. It is to be noted herein that rapid charging may refer to a charging state in which a charging current is more than or equal to 2.5 A, or a charging state in which rated output power is not lower than 15 W. The normal charging may refer to a charging state in which the charging current is lower than 2.5 A, or a charging state in which the rated output power is lower than 15 W.

According to another embodiment of the disclosure, as illustrated in FIG. 6-FIG. 10, there are two first contact surfaces 131 positioned on two opposite sidewalls of the power pin 130. That is, two surfaces on the power pin 130 are adapted to be electrically connected with the conductive member, and other surfaces of the power pin 130 are adapted to be wrapped with the insulating coating portion 140.

Figure 6:
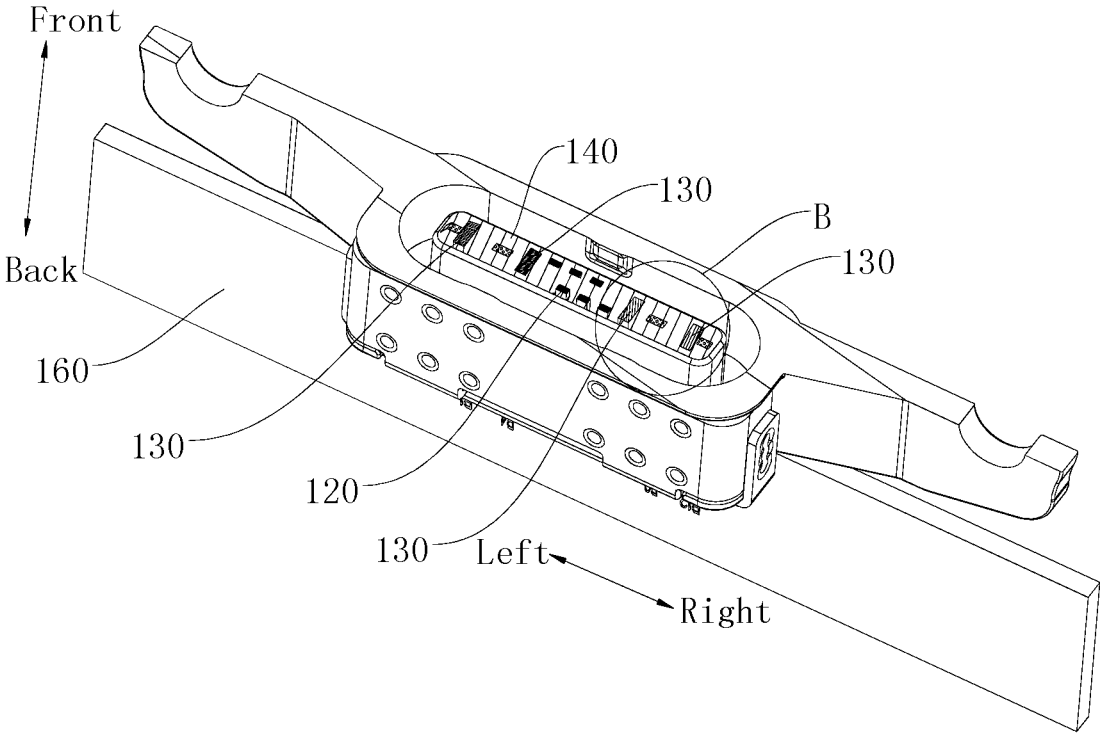
FIG. 6 illustrates a sectional view of a power interface according to an embodiment of the disclosure.
Figure 7:
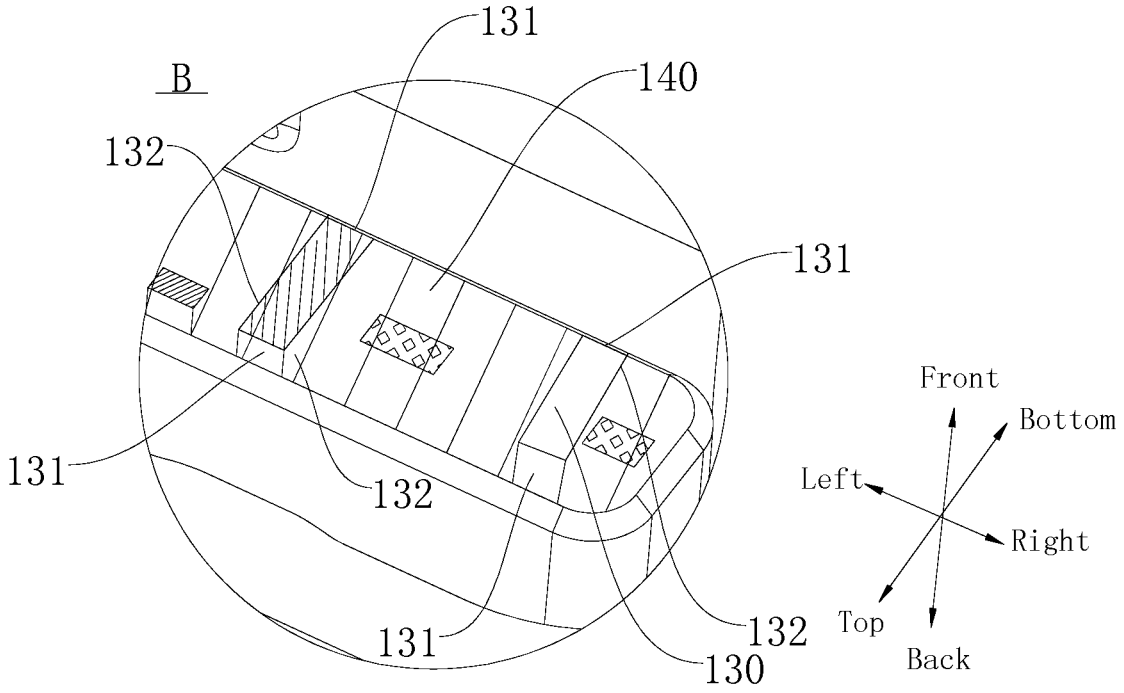
FIG. 7 illustrates a partial enlarged schematic view of part B in FIG. 6.

In a related art, pins of a power interface include two rows of pins arranged in a vertical direction. Each row of the pins includes multiple pills spaced from one another, and the pins positioned in the upper rows are arranged opposite to the pins positioned in the lower row. It can be understood that, in the power interface 100 in the embodiments, as illustrated in FIG. 6 and FIG. 7, two pins opposite in a vertical direction in a conventional art are designed into one power pin 130. Two sidewall surfaces of the power pin 130 are constructed as plugging surfaces adapted to be electrically connected with the power adapter. Therefore, a cross-sectional area of the power pin 130 may be enlarged, thereby increasing the current load capacity of the power pin 130 and thus the current transmission speed. Thus, the power interface 100 is endowed with the rapid charging function, and the charging efficiency for the battery may be improved.

Figure 8:
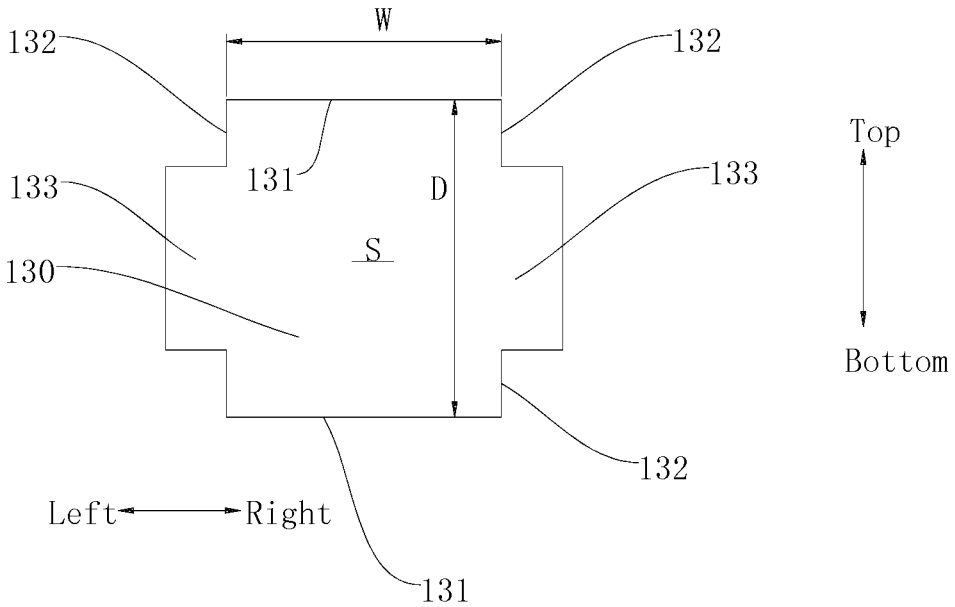
FIG. 8 illustrates a structure view of a power pin of a power interface according to an embodiment of the disclosure.
Figure 10:
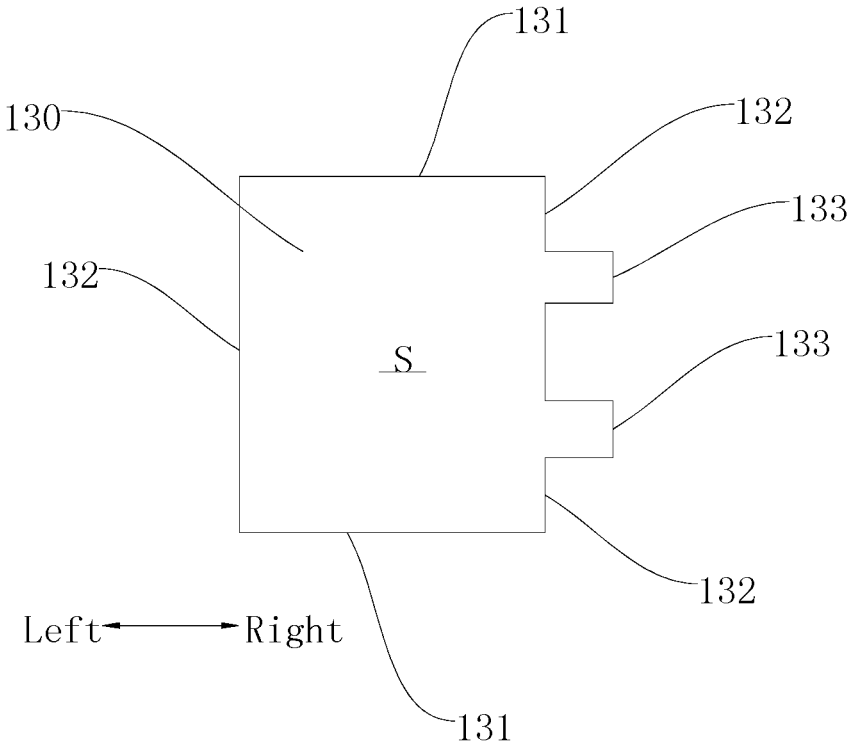
FIG. 10 illustrates a structure view of a power pin of a power interface according to an embodiment of the disclosure.

According to an embodiment of the disclosure, as illustrated in FIG. 8 and FIG. 10, there may be multiple protrusions 133 spaced from one another. On one hand, the cross-sectional area of the power pin 130 may be enlarged, thereby increasing the current load capacity of the power pin 130. On the other hand, a contact area between the power pin 130 and the insulating coating portion 140 may be enlarged, thereby improving attach-ability between the insulating coating portion 140 and the power pin 130, and thus improving plugging and unplugging lifetime of the power interface 100 and retarding fatigue damage to the power interface 100.

In an embodiment of the disclosure, as illustrated in FIG. 10, the multiple protrusions 133 are positioned on the same second contact surface 132. It can be understood that an arrangement manner for the multiple protrusions 133 is not limited thereto. For example, in another embodiment of the disclosure, as illustrated in FIG. 8, there are two second contact surfaces 132 positioned on the two opposite sidewalls of the power pin 130, and there are two protrusions 133, each of which is positioned on the respective one of the two second contact surfaces 132.

According to an embodiment of the disclosure, the cross-sectional area of the power pin 130 is S, $S \geq 0.09805\ mm^2$. Experiments show that, when $S \geq 0.09805\ mm^2$, the current load capacity of the power pin 130 is at least 10 A and thus the current load capacity of the power pin 130 may be increased to improve the charging efficiency. Further tests show that, when $S=0.13125\ mm^2$ or $S=0.175\ mm^2$, the current load capacity of the power pin 130 may reach 12 A or more and thus the charging efficiency may be improved.

Figure 5:
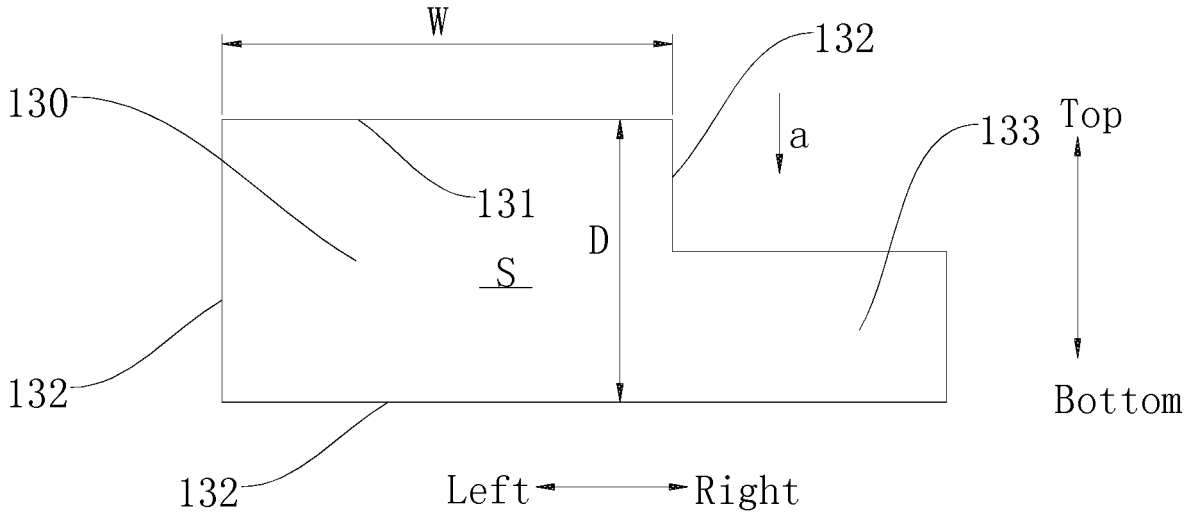
FIG. 5 illustrates a structure view of a power pin of a power interface according to an embodiment of the disclosure.

According to an embodiment of the disclosure, as illustrated in FIG. 5 and FIG. 8, a width of the first contact surface 131 in a width direction (a left-right direction illustrated in FIG. 5 and FIG. 8) of the power pin 130 is W, W meets the following requirement: $0.24\ mm \leq W \leq 0.32\ mm$. Experiments show that, when $0.24\ mm \leq W \leq 0.32\ mm$, the current load capacity of the power pin 130 is at least 10 A and thus the current load capacity of the power pin 130 may be increased to improve the charging efficiency. Further tests show that, when W=0.25 mm, the current load capacity of the power pin 130 may be greatly increased, the current load capacity of the power pin 130 is 12 A or more and thus the charging efficiency may be improved.

According to an embodiment of the disclosure, as illustrated in FIG. 5 and FIG. 8, a thickness of the power pin 130 is D, and D meets the following requirement: $D \leq 0.7\ mm$. Herein, the "thickness" may refer to a width of the power pin 130 in the top-bottom direction illustrated in FIG. 5 and FIG. 8.

It is to be noted that, for improving versatility of the power interface 100, a structural design of the power interface 100 is required to meet a certain design standard. For example, if a maximum thickness of the power interface 100 in the design standard of the power interface 100 is h, when the power pin 130 is designed, the thickness D of the power pin 130 is required to be less than or equal to h. Further, under the condition that $D \leq h$ is met, the larger the thickness D of the power pin 130 is, the higher current load capacity loadable for the power pin 130 will be obtained, and the higher charging efficiency of the power interface 100 will be obtained. For example, for a Universal Serial Bus (USB) Type-C interface, a design standard of a thickness of the USB Type-C interface is h=0.7 mm. When the power interface 100 is designed, $D \leq 0.7\ mm$ is required to be met Therefore, the power interface 100 may meet a versatility requirement. Moreover, compared with the related art, the cross-sectional area of the power pill 130 may also be enlarged, thereby increasing the current load capacity of the power pin 130 and further improving the charging efficiency.

Figure 2:
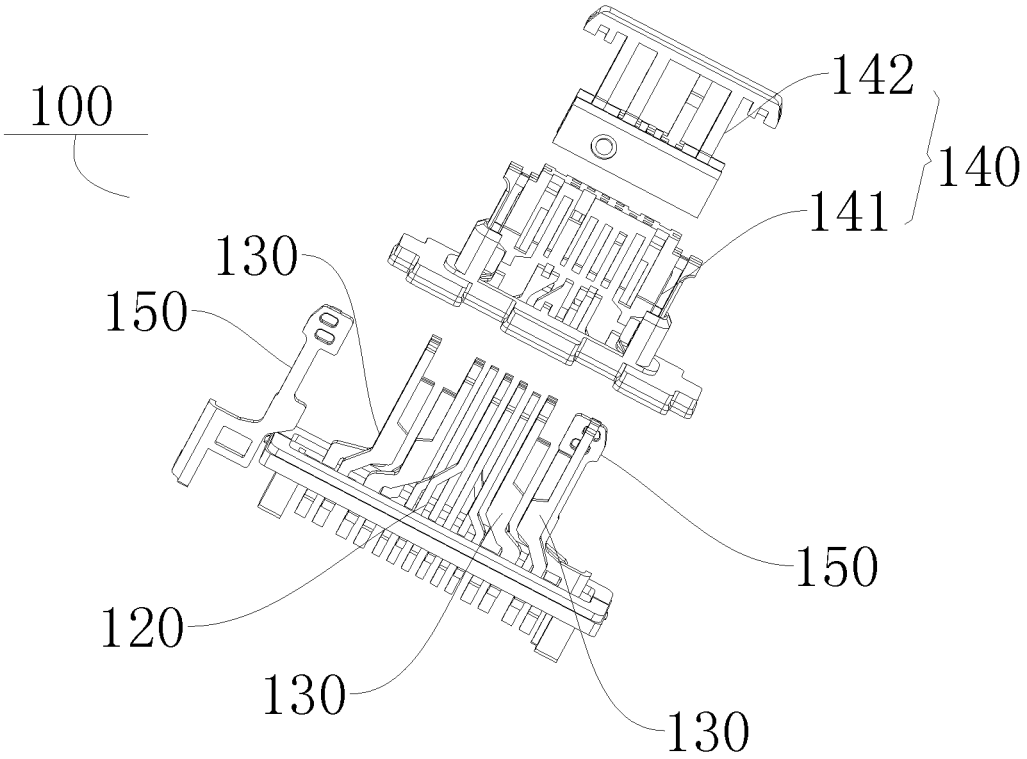
FIG. 2 illustrates an exploded view of a power interface according to an embodiment of the disclosure.
Figure 3:
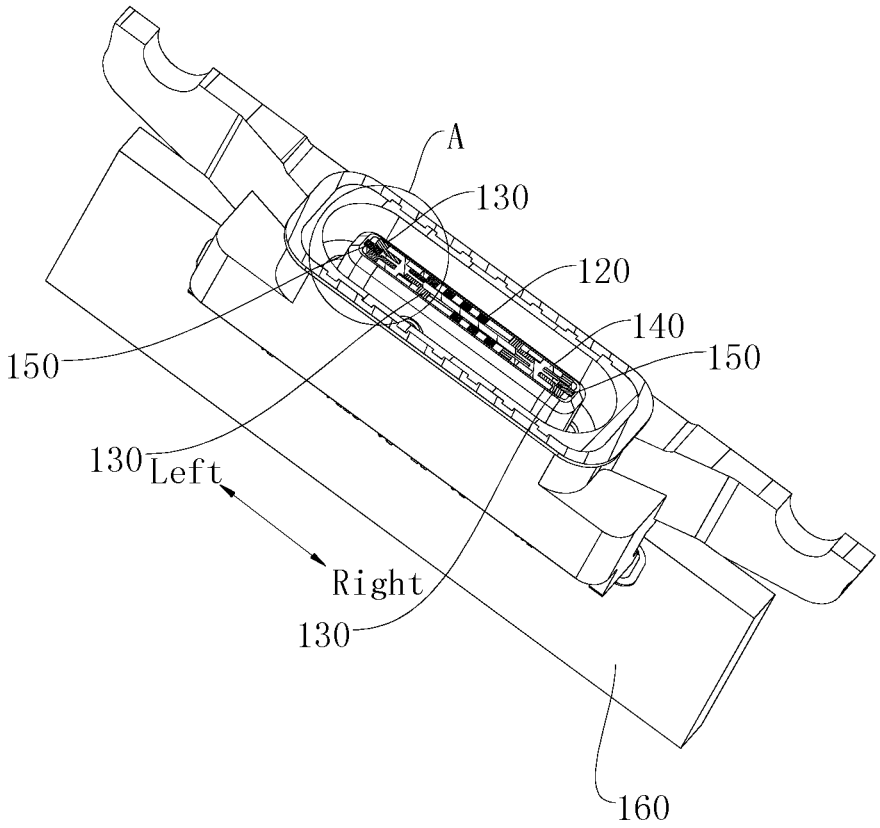
FIG. 3 illustrates a sectional view of a power interface according to an embodiment of the disclosure.
Figure 4:
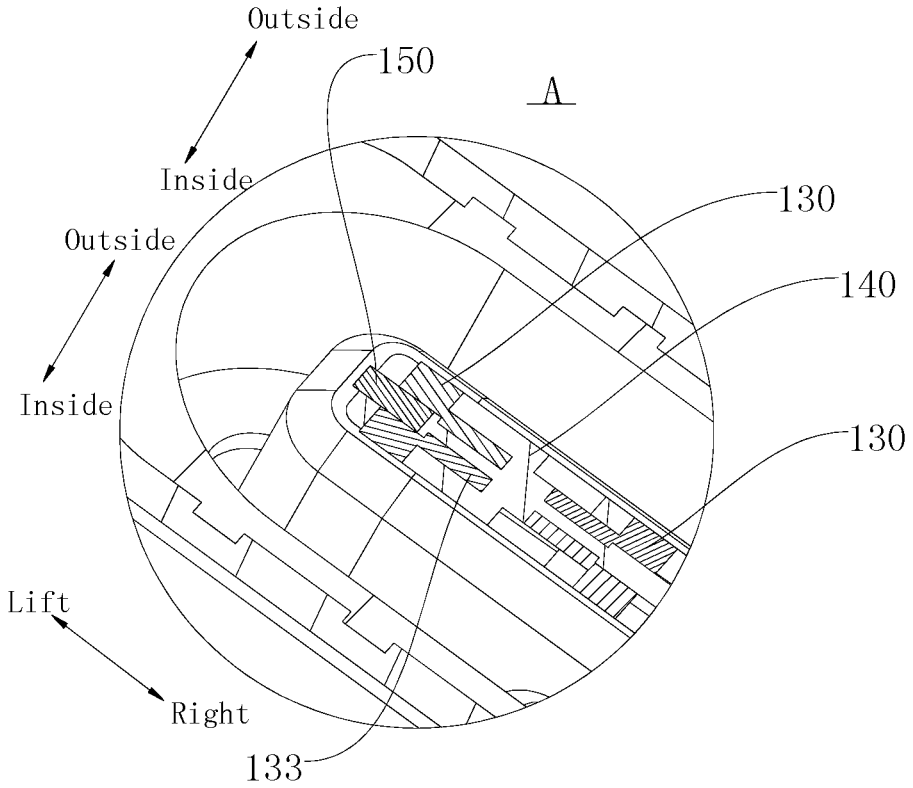
FIG. 4 illustrates a partial enlarged schematic view of part A in FIG. 3.

For improving heat-sink efficiency of the power interface 100, according to an embodiment of the disclosure, as illustrated in FIG. 2, the insulating coating portion 140 may be a heat-sink coating portion made from a thermal conductive insulating material. According to an embodiment of the disclosure, the insulating coating portion 140 may include a first coating portion 141 and a second coating portion 142. The second coating portion 142 is embedded into the first coating portion 141. According to an embodiment of the disclosure, some of the power pins 130 are VBUS pins, and some of the power pins 130 are GND pins.

The power interface 100 according to the embodiments of the disclosure will be described below with reference to FIG. 1-FIG. 10 in detail. It is to be understood that the following descriptions are not specific limits to the disclosure but only exemplary descriptions.

Embodiment 1

For ease of the description, the power interface 100 is described as a Type-C interface, for example. A Type-C interface is an abbreviation of a USB Type-C interface. It is an interface form and is a totally new data, video, audio, electrical energy transmission interface specification drafted by the USB standardization organization to overcome the longstanding shortcomings of USB interfaces that physical interface specifications are not unified, electrical energy may be unidirectionally transmitted only and the like.

A characteristic of the Type-C is that a standard device may claim its intention for occupying a VBUS (i.e., a positive connecting line of a conventional USB) to another connected party through a CC pin in an interface specification, the party with a relatively strong intention finally outputs a voltage and a current to the VBUS and the other party accepts power supplied by the VBUS or still refuses the supplied power but without influence on a transmission function. For more conveniently using this bus definition, a Type-C interface chip (for example, LDR6013) usually divides devices into four roles: a Downstream Facing Port (DFP), a strong Dual Role Port (DRP), a DRP and an Upstream Facing Port (UFP). Intentions of the four roles for occupying the VBUS are progressively weakened in sequence.

Herein, the DFP is equivalent to an adapter and may keep intended to output a voltage to the VBUS. The strong DRP is equivalent to a mobile power supply and may stop output to the VBUS only when there is an adapter. The DRP is equivalent to a mobile terminal, expects to be powered by an opposite party under a normal condition and, when there is a device weaker than itself, reluctantly outputs a voltage to the opposite party. The UFP never externally outputs electrical energy and is usually a weak-battery device or battery-free device, for example, a Bluetooth headset. The USB Type-C supports normal and reverse plugging. Since there are totally four groups of power supplies and Grounds (GND) on front and reverse surfaces, supported power may be greatly improved.

The power interface 100 in the embodiments may be a USB Type-C interface, may be applied to a power adapter with a rapid charging function and is also applied to an ordinary power adapter. It is to be noted herein that rapid charging may refer to a charging state in which a charging current is higher than 2.5 A or a charging state in which rated output power is not lower than 15 W and normal charging may refer to a charging state of which the charging current is less than or equal to 2.5 A or a charging state in which the rated output power is lower than 15 W. That is, when the power adapter with the rapid charging function is adopted to charge the power interface 100, the charging current is more than or equal to 2.5 A or rated output power is not lower than 15 W and, when the ordinary power adapter is adopted to charge the power interface 100, the charging current is lower than 2.5 A or the rated output power is lower than 15 W.

For standardizing the power interface 100 and the power adapter adapted to the power interface 100, a size of the power interface 100 meets a design requirement of a standard interface. For example, if a width (a width in a left-right direction of the power interface 100, the left-right direction illustrated in FIG. 1) consistent with a design requirement of a power interface 100 with 24 pins is a, a width (a width in the left-right direction of the power interface 100, the left-right direction illustrated in FIG. 1) of the power interface 100 in the embodiments is also a, for making the power interface 100 in the embodiments meet a design standard. For enabling power pins 130 to load relatively high charging currents in a limited space, some of pins among the 24 pins may be removed and, meanwhile, cross-sectional areas of the power pins 130 are enlarged to load the relatively high charging currents. Enlarged parts of the power pins 130 may be arranged at positions of the removed pins, by which, on one hand, an optimal layout of parts of the power interface 100 is implemented and, on the other hand, a current loading capability of the power pins 130 is improved.

Specifically, as illustrated in FIG. 1-FIG. 5, the power interface 130 includes a body portion 110, six data pins 120 and eight power pins 130. The six data pins 120 are A5, A6, A7, B5, B6 and B7 respectively, the eight power pins 130 are A1, A4, A9, A12, B1, B4, B9 and B12 respectively, four of the eight power pins 130 are four VBUS pins and the other four are GND pins. A middle patch 150 is sandwiched by two opposite GND pins. It is to be noted that the power interface 100 may be formed in a mobile terminal, a battery may be arranged in the mobile terminal (for example, a mobile phone, a tablet computer and a notebook computer) and an external power supply may be connected with the power interface 100 through a power adapter to further charge the battery. Each power pin 130 includes at least one first contact surface 131 adapted to be electrically connected with a conductive member and at least one second contact surface 132 adapted to be wrapped with an insulating coating portion 140 and at least one protrusion 133 is arranged on the second contact surface 132 to increase a current load capacity of the power pin 130.

As illustrated in FIG. 5, there may be one first contact surface 131, and there is one protrusion 133 formed on a wall surface of a right side of the power pin 130. That is, the protrusion 133 is formed on the second contact surface 132 positioned on the right side of the power pin 130. During rapid charging of the power interface 100, the power pin 130 with the protrusion 133 may be configured to be loaded with a relatively high charging current. During normal charging of the power interface 100, the insulating coating portion 140 on the power pin 130 may avoid the contact of the power pin 130 with a corresponding pin on a power adapter. Therefore, the power interface 100 in the embodiments may be applied to different power adapters. For example, during rapid charging of the power interface 100, the power interface 100 may be electrically connected with a corresponding power adapter with the rapid charging function. During normal charging of the power interface 100, the power interface 100 may be electrically connected with a corresponding ordinary power adapter, and the insulating coating portion 140 may effectively space the protrusion 133 from a corresponding pin on the power adapter, so as to protect the pin on the power adapter from a charging interference generated by the protrusion 133, thereby improving adaptability of the power interface 100 to the power adapter for normal charging and improving stability of the power interface 100 in a normal charging state.

As illustrated in FIG. 5, a cross-sectional area of the power pin 130 is S and a width of the first contact surface 131 in a width direction (a left-right direction illustrated in FIG. 5 and FIG. 8) of the power pin 130 is W. Tests show that, when $S=0.13125\ mm^2$ and $W=0.25$ mm, the current load capacity of the power pin 130 may be 10 A, 12 A, 14 A or more and thus the charging efficiency may be improved.

A thickness of the power pin 130 is D and D meets $0.1\ mm \le D \le 0.3$ mm. Herein, the "thickness" may refer to a width of the power pin 130 in a top-bottom direction illustrated in FIG. 5 and FIG. 8. Experiments show that, when $0.1\ mm \le D \le 0.3$ mm, the current load capacity of the power pin 130 is at least 10 A and thus the current load capacity of the power pin 130 may be increased to improve the charging efficiency.

Further tests show that, when $S=0.13125\ mm^2$, $W=0.25$ mm and $D=0.25$ mm, the current load capacity of the power pin 130 may be greatly increased, the current load capacity of the power pin 130 may be 10 A, 12 A, 14 A or more and thus the charging efficiency may be improved.

As illustrated in FIG. 2, the insulating coating portion 140 may be a heat-sink coating portion made from an thermal conductive insulating material and includes a first coating portion 141 and a second coating portion 142, and the second coating portion 142 is embedded into the first coating portion 141.

In such a manner, the widened portion 132 is arranged on the power pin 130 and then the current load capacity of the power pin 130 may be increased. Thus, a current transmission speed may be increased, the power interface 100 is endowed with the rapid charging function, and the charging efficiency for the battery is improved.

Embodiment 2

Figure 9:
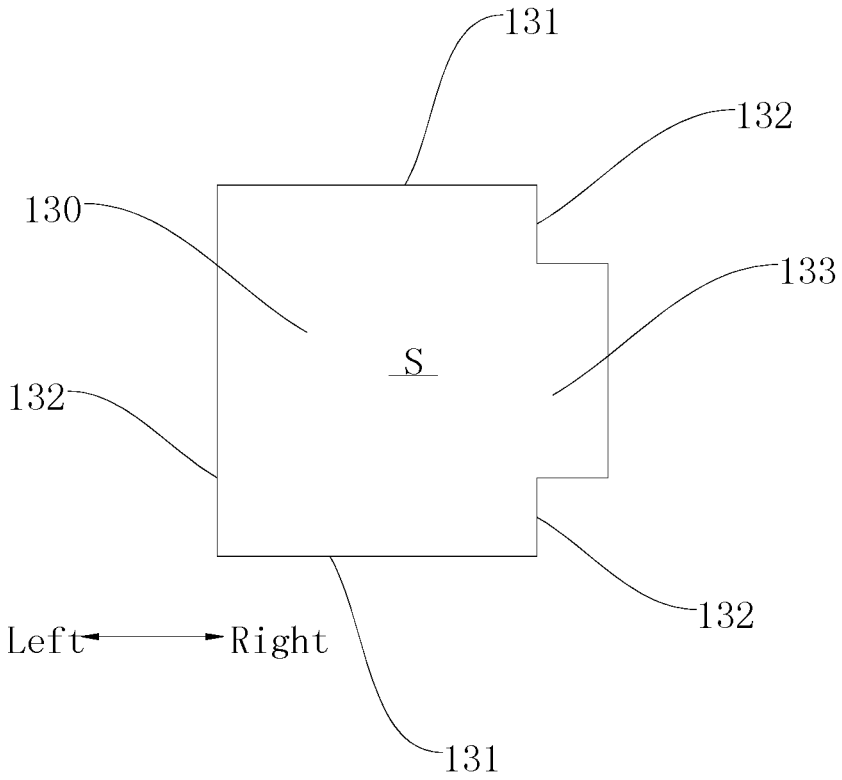
FIG. 9 illustrates a structure view of a power pin of a power interface according to an embodiment of the disclosure.

As illustrated in FIG. 6-FIG. 7 and FIG. 9, this embodiment differs from embodiment 1 in that, in the embodiment, there are two first contact surfaces 131 positioned on two opposite sidewalls of the power pin 130. That is, there are two surfaces adapted to be electrically connected with the conductive member of the power adapter on the power pin 130, and other surfaces of the power pin 130 are adapted to be wrapped with the insulating coating portion 140.

In the related art, pins of a power interface include two rows of pins arranged in a vertical direction. Each row of the pins includes multiple pins spaced from one another. The pins positioned in the upper rows are arranged opposite to the pins positioned in the lower row. It can be understood that, in the power interface 100 in the embodiment, as illustrated in FIG. 6 and FIG. 7, two pins opposite in vertical direction in the conventional art are designed into one power pin 130. Two sidewall surfaces of the power pin 130 are constructed as plugging surfaces adapted to be electrically connected with the power adapter. Therefore, the cross-sectional area of the power pin 130 may be enlarged, thereby increasing the current load capacity of the power pin 130 and thus the current transmission speed. Thus, the power interface 100 is endowed with the rapid charging function, and the charging efficiency for the battery is increased.

As illustrated in FIG. 9, an outer contour line of a cross section of the power pin 130 is substantially rectangular and includes two first contact surfaces 131 and two second contact surfaces 132. The two first contact surfaces 131 are positioned on two opposite wall surfaces of the power pin 130, the two second contact surfaces 132 are positioned between the two first contact surfaces 131. There is one protrusion 133 positioned on one second contact surface 132.

As illustrated in FIG. 5 and FIG. 8, the cross-sectional area of the power pin 130 is S, the thickness of the power pin 130 is D, the cross-sectional area of the power pin 130 is S and the width of the first contact surface 131 in the width direction (the left-right direction illustrated in FIG. 5 and FIG. 8) of the power pin 130 is W. Tests show that, when $S=0.175\ mm^2$, $W=0.25$ mm and $D\leq 0.7$ mm, the current load capacity of the power pin 130 may be greatly increased, the current load capacity of the power pin 130 may be 10 A, 12 A, 14 A or more and thus the charging efficiency may be improved. It is to be noted that, for improving the versatility of the power interface 100, a structural design of the power interface 100 is required to meet a certain design standard. For example, if a maximum thickness of the power interface 100 in the design standard of the power interface 100 is h, when the power pin 130 is designed, the thickness D of the power pin 130 is required to be less than or equal to h. Under the condition that $D\leq h$ is met, the larger the thickness D of the power pin 130 is, the higher the current load capacity loadable for the power pin 130 will be obtained, and the higher the charging efficiency of the power interface 100 will be obtained. For example, for a USB Type-C interface, a design standard of a thickness of the USB Type-C interface is $h=0.7$ mm and, when the power interface 100 is designed, $D\leq 0.7$ mm is required to be met. Therefore, the power interface 100 may meet a versatility requirement. Moreover, compared with the related art, the cross-sectional area of the power pin 130 may also be enlarged, thereby increasing the current load capacity of the power pin 130 and further improving the charging efficiency.

Embodiment 3

As illustrated in FIG. 6-FIG. 7 and FIG. 8, this embodiment differs from embodiment 2 is that, in the embodiment, there are two protrusions 133, each of which is positioned on a respective one of the two second contact surfaces 132.

Embodiment 4

As illustrated in FIG. 6-FIG. 7 and FIG. 10, this embodiment differs from embodiment 3 in that, in the embodiment, there are two protrusions 133. Both of the two protrusions 133 are positioned on the same second contact surface 132, and the two protrusions 133 are spaced apart.

A mobile terminal according to the embodiments of the disclosure includes the abovementioned power interface 100. The mobile terminal may implement transmission of an electrical signal and a data signal through the power interface 100. For example, the mobile terminal may be electrically connected with a power adapter through the power interface 100 to realize a charging or data transmission function.

According to the mobile terminal of the embodiments of the disclosure, a protrusion 133 is arranged on a second contact surface 131 adapted to be wrapped with an insulating coating portion 140, and then a current load capacity of a power pin 130 may be increased, so that a current transmission speed may be increased. Thus, the power interface 100 is endowed with a rapid charging function, and charging efficiency for a battery is improved.

A power adapter according to the embodiments of the disclosure is provided with the abovementioned power interface 100. A mobile terminal may implement transmission of an electrical signal and a data signal through the power interface 100.

According to the power adapter of the embodiments of the disclosure, a protrusion 133 is arranged on a second contact surface 131 adapted to be wrapped with an insulating coating portion 140, and then a current load capacity of a power pin 130 may be increased, so that a current transmission speed may be increased. Thus, power interface 100 is endowed with a rapid charging function, and charging efficiency for a battery is improved.

A power interface 100 according to the embodiments of the disclosure includes a body portion 110 adapted to be connected with a circuit board 160, multiple data pins 120 spaced from one another, and multiple power pins 130 spaced from one another.

The data pins 120 are connected with the body portion 110, the power pins 130 are connected with the body portion 110 and the power pins 130 are spaced from the data pins 120. Each power pin 130 includes at least one first contact surface electrically connected with a conductive member and at least one second contact surface 132 not contacting with the conductive member and at least one protrusion 133 is arranged on the second contact surface 132 to increase a current load capacity of the power pin 130.

According to the power interface 100 of the embodiments of the disclosure, the at least one protrusion 133 is arranged on the second contact surface 132 not contacting with the conductive member, and then the current load capacity of the power pin 130 may be increased, so that a current transmission speed may be increased. Thus, the power interface 100 is endowed with a rapid charging function, and charging efficiency for a battery is improved.

In the descriptions of the specification, the descriptions made with reference to terms "an embodiment", "some embodiments", "example", "specific example", "some examples" or the like refer to that specific features, structures, materials or characteristics described in combination with the embodiment or the example are included in at least one embodiment or example of the disclosure. In the specification, these terms are not always schematically expressed for the same embodiment or example. Moreover, the specific described features, structures, materials or characteristics may be combined in a proper manner in any one or more embodiments or examples. In addition, those skilled in the art may integrate and combine different embodiments or examples described in the specification and features of different embodiments or examples without conflicts.

The embodiments of the disclosure have been illustrated or described above. However, it can be understood that the abovementioned embodiments are exemplary and should not be understood as limits to the disclosure and those of ordinary skill in the art may make variations, modifications, replacements, transformations to the abovementioned embodiments within the scope of the disclosure.

The invention claimed is:

1. A power interface, comprising:

a body portion adapted to be connected with a circuit board;

multiple data pins spaced from one another, the data pins being connected with the body portion; and multiple power pins spaced from one another, the power pins being connected with the body portion, the power pins being spaced from the data pins, each power pin comprising two first contact surfaces and at least one second contact surface adapted to be wrapped with an insulating coating portion and extending perpendicular to the first contact surfaces, the two first contact surfaces being positioned on two opposite sidewalls of the power pin, one of the two first contact surfaces being adapted to be electrically connected with one conductive member of a power adapter, the other one of the two first contact surfaces being adapted to be electrically connected with another one conductive member of the power adapter different from said one conductive member, at least one protrusion being arranged on the second contact surface to increase a current load capacity of the power pin.

2. The power interface of claim 1, wherein there are multiple protrusions spaced from one another.

3. The power interface of claim 2, wherein the multiple protrusions are positioned on the same second contact surface.

4. The power interface of claim 2, wherein there are two second contact surfaces, the two second contact surfaces being positioned on two opposite sidewalls of the power pin; and there are two protrusions, each of the two protrusions being positioned on a respective one of the two second contact surfaces.

5. The power interface of claim 1, wherein a cross-sectional area of the power pin is S, $S \geq 0.09805\ mm^2$.

6. The power interface of claim 5, wherein $S=0.13125\ mm^2$ or $S=0.175\ mm^2$.

7. The power interface of claim 1, wherein a width of the first contact surface in a width direction of the power pin is W, and W meets the following requirement: $0.24\ mm \leq W \leq 0.32\ mm$.

8. The power interface of claim 7, wherein W=0.25 mm.

9. The power interface of claim 1, wherein a thickness of the power pin is D, and D meets the following requirement: $D \leq 0.7\ mm$.

10. The power interface of claim 1, wherein the insulating coating portion is a heat-sink coating portion.

11. The power interface of claim 10, the heat-sink coating portion is made from a thermal conductive insulating material.

12. The power interface of claim 1, wherein some of the power pins are VBUS pins, and some of the power pins are Ground (GND) pins.

13. A mobile terminal, comprising a power interface, the power interface comprising:

a body portion adapted to be connected with a circuit board;

multiple data pins spaced from one another, the data pins being connected with the body portion; and multiple power pins spaced from one another, the power pins being connected with the body portion, the power pins being spaced from the data pins, each power pin comprising two first contact surfaces and at least one second contact surface adapted to be wrapped with an insulating coating portion and extending perpendicular to the first contact surfaces, the two first contact surfaces being positioned on two opposite sidewalls of the power pin, one of the two first contact surfaces being adapted to be electrically connected with one conductive member of a power adapter, the other one of the two first contact surfaces being adapted to be electrically connected with another one conductive member of the power adapter different from said one conductive member, at least one protrusion being arranged on the second contact surface to increase a current load capacity of the power pin.

* * * * *